US007641518B2

(12) United States Patent
Lee et al.

(10) Patent No.: US 7,641,518 B2
(45) Date of Patent: Jan. 5, 2010

(54) SATA DATA CONNECTOR

(75) Inventors: Chung-Liang Lee, Taipei (TW); Hsi-Hsi Wu, Taipei (TW); Hung Yu Chang, Taipei (TW)

(73) Assignee: Innodisk Corporation, Taipei (TW)

( * ) Notice: Subject to any disclaimer, the term of this patent is extended or adjusted under 35 U.S.C. 154(b) by 0 days.

(21) Appl. No.: 11/889,528

(22) Filed: Aug. 14, 2007

(65) Prior Publication Data

US 2008/0274631 A1 Nov. 6, 2008

(30) Foreign Application Priority Data

May 3, 2007 (TW) ..... 96207058 U

(51) Int. Cl.
*H01R 24/00* (2006.01)

(52) U.S. Cl. ..... 439/660; 439/188

(58) Field of Classification Search ..... 439/188, 439/620.14, 660

See application file for complete search history.

(56) References Cited

U.S. PATENT DOCUMENTS 7,393,247 B1 * 7/2008 Yu et al. ..... 439/638
2006/0279885 A1 * 12/2006 Sung et al. ..... 361/42

* cited by examiner

*Primary Examiner*—Edwin A. Leon
*Assistant Examiner*—Vanessa Girardi
(74) *Attorney, Agent, or Firm*—Rosenberg, Klein & Lee

(57) ABSTRACT

A modified standard SATA data connector is provided with a power supply circuit. The connector includes male and female data connectors. A male signal interface has seven male data connection pins, consisting of four data, a power supply, and two ground pins, the power supply pin replacing one of three original ground pins and connecting with a power line of a circuit board. A corresponding female signal interface has seven female data connection pins consisting of four data, a power receiving, and two ground pins. While the female and male data connectors are engaged, power can be supplied from the power line of the circuit board to an applied device connected with the female data connector via the power supplying and receiving pins. Thus, the SATA data connector can work without an external SATA power cable, and the volume of the cable can be reduced.

6 Claims, 10 Drawing Sheets

SATA DATA CONNECTOR

FIELD OF THE INVENTION

The present invention relates to a SATA data connector, and more particular to a SATA data connector with a power supply circuit.

BACKGROUND

In accordance with the progressing of the computer development, the storage device plays a most important role. A hard disk is used to be the storage device provided within the computer, having with the communication interface, which was conformed to the specification of the Parallel Advanced Technology Attachment (PATA), and further, the recent communication interface thereof has been advanced to conform to the specification of the Serial Advanced Technology Attachment (SATA). The recent data transmission speed is getting higher substantially through the SATA communication interface, such as more than 150 Mb/s, the volume of the transmission line fitted in with the SATA communication interface is getting smaller, and the length thereof is getting longer, such as 100 cm.

Referring to the FIG. 1 is a three-dimensional diagram of the prior art SATA transmission interface. The SATA data connector 12 comprises a male data connector 11 and a female data connector 13, wherein the male connector 11 is set on a computer system, a motherboard, or a circuit board 10 to connect with other devices on the circuit board 10. The female data connector 13 is set on the end of the SATA data cable 135, and another end of the SATA data cable 135 can be connected with an external device 15, such as the hard disk, the DVD ROM, the memory device, or other devices. Regarding to the external device 15 cannot have the operating power through the SATA data cable 135, the external device 15 has to be connected to a power supply 17 through the SATA power connector 18 or a SATA power cable 175 for being supplied by the operating power.

According to the demand of various voltages for supplying the SATA external device 15, the specification of the SATA defines the operating voltages, including 12V, 5V, 3.3V, 0.7V, and 250 mV. Due to the consideration of that, the volume of the SATA power cable 175 has to be larger.

In general, the conventional SATA data connector 12 has seven connection pins (S1-S7) that consist of three ground pins (GND), and four data pins, and the SATA power connector 18 has fifteen connection pins (P1-P15).

However, there are many problems of the SATA communication interface still, although many advantages have mentioned previously.

1. Due to there is nothing relative to the power line designed internally within the SATA data connector, a SATA power cable is used to connect with a power supply externally, however, once a device simply requires to be supplied power by 5V or 3.3V only, such as a Solid State Disk (SSD), the SATA power cable will be used inconveniently due to the structure of which is too complex because that supports a lot of operating powers.
2. The connection between the male data connector and the female data connector within the SATA data connector is very unstable. Once an external force is applied on the male data connector or the female data connector, the link thereof should be failure, therefore, the hardware should be damaged or the data should be lost.
3. The conventional SATA male data connector and the SATA female data connector are connected each other with single contact mode, and the data transmission speed is about 3.0 Gb/s. As the connection between the SATA male data connector and the SATA female data connector is loose by an external force, the transmission data must be damaged.

SUMMARY OF THE INVENTION

It is a primary object of the present invention to provide a SATA data connector, wherein one of three ground pins of the SATA data connector can be used to be a power supplying pin, such that the SATA data connector can work without the external SATA power cable, and the amount and volume of the cable can be reduced.

It is a secondary object of the present invention to provide a SATA data connector, wherein the connection between the female data connector and the male data connector will not be loosened easily by an external force, since the female data connector and the male data connector can be respectively a female header and a pin header to ensure the stability and correction during data transmission.

It is another object of the present invention to provide a SATA data connector, wherein the male data connector on the circuit board comprises a male signal interface and a power supplying line, and the female data connector of the SATA data connector comprises a female signal interface and a power receiving line, such that the male data connector can supply operating power and transmit data to the female data connector, and the SATA data connector can work without the external SATA power cable.

It is another object of the present invention to provide a SATA data connector, wherein a power supply circuit can be provided between the circuit board and the female data connector according to the layout of the power supplying line and the power receiving line, and the connection between the male data connector and the female data connector can be tighter to prevent the loose between link thereof.

To achieve the previous mentioned objects, the present invention provides a SATA data connector, comprising: a male data connector comprising seven male connection pins having a power supplying pin, two ground pins, and four data pins, the power supplying pin being electrically connected with a power line of a circuit board; and a female data connector comprising seven female connection pins having a power receiving pin, two ground pins, and four data pins, wherein the female data connector can connect with the male data connector, and the power receiving pin of the female data connector can contact the power supplying pin of the male data connector, such that the power line of the circuit board, the power supplying pin of the male data connector, and the power receiving pin of the female data connector can form a power supply circuit.

To achieve the previous mentioned objects, the present invention provides a SATA data connector, comprising a female data connector having a plurality of female connection pins and one of a power receiving line or a power receiving pin, wherein the female connection pins comprise at least one ground pin and a plurality of data pins.

To achieve the previous mentioned objects, the present invention provides a SATA data connector, comprising a female data connector having a plurality of female connection pins, an applied device, and a power connection hole, the applied device connecting with the female connection pins and the power connection hole, the female connection pins comprising at least one ground pin and a plurality of data pins, wherein the applied device can be one of a memory, a control device, a circuit board, or a combination thereof, and the power connection hole can connect with a power supply via a SATA power cable.

To achieve the previous mentioned objects, the present invention provides a SATA data connector, comprising: a male data connector comprising a plurality of male connection pins having at least one ground pin, a power supplying pin, and a plurality of data pins; and a female data connector comprising a plurality of female connection pins having at least one ground pin, a power receiving pin, and a plurality of data pins, wherein the female data connector can connect with the male data connector, such that the power supplying pin can contact with the power receiving pin to form a power supply circuit, and the male connector pin can be one of a gold finger, a pin header, or a female header, and the female connector pin can be one of a gold finger, a female header, or a pin header.

DETAILED DESCRIPTION

Figure 1:
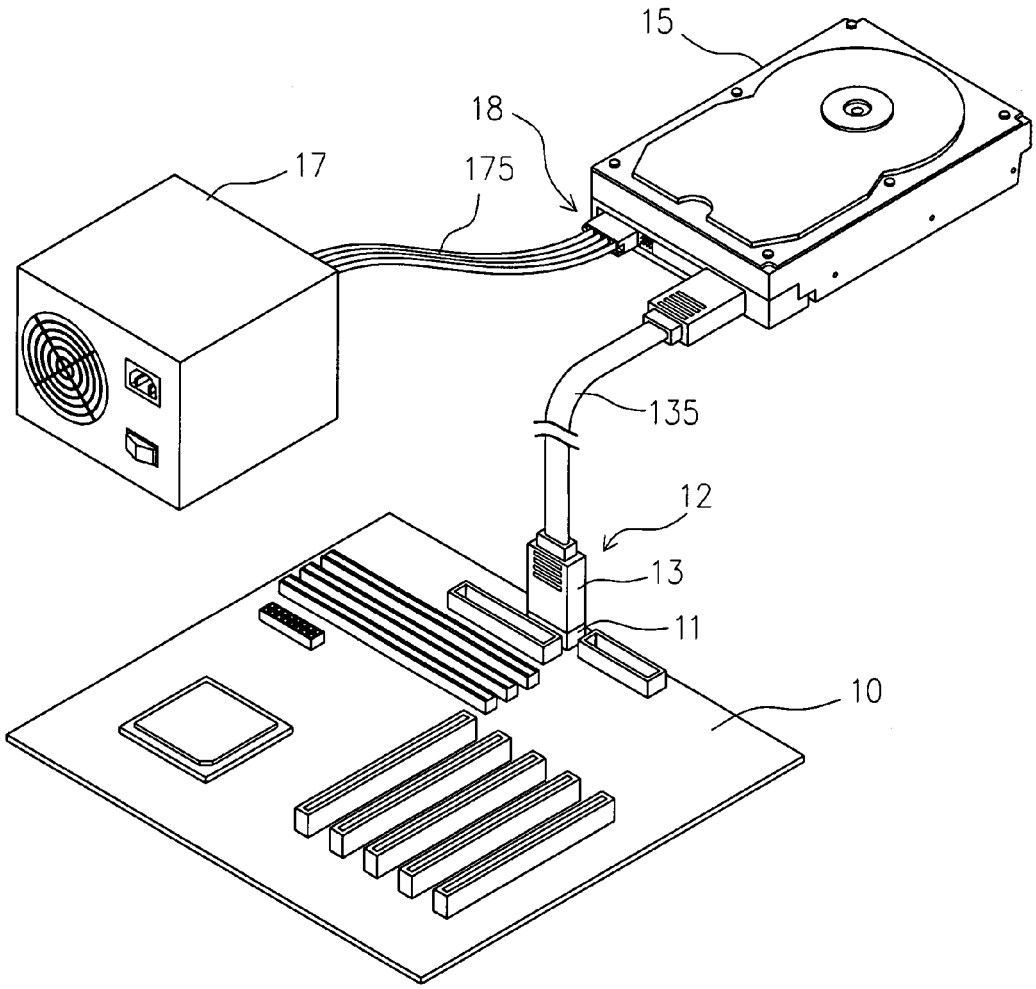
FIG. 1 (PRIOR ART)
FIG. 1 is a three-dimensional diagram of the prior art due to that SATA transmission interface is applied.
Figure 2:
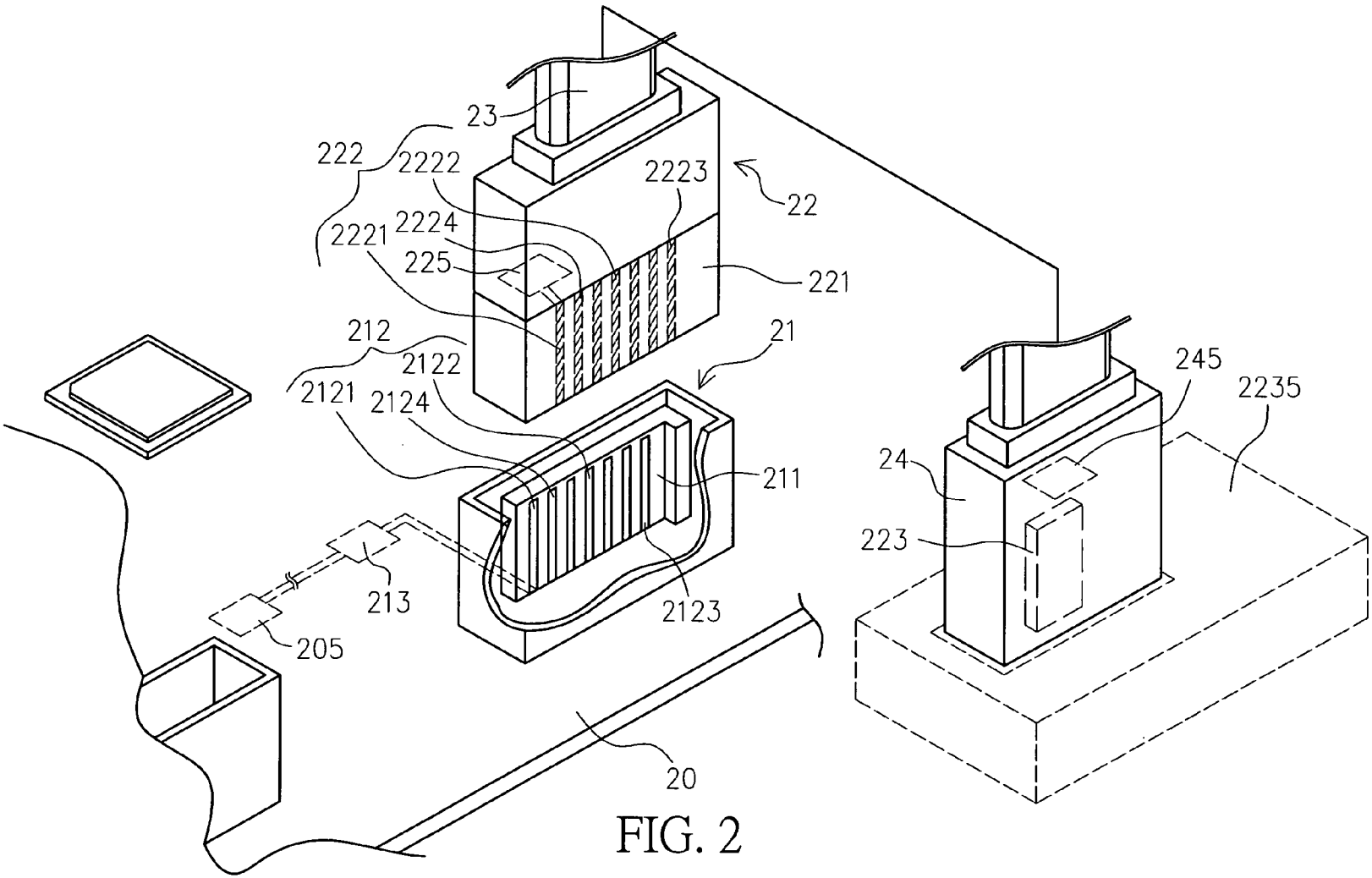
FIG. 2 is a three-dimensional diagram of a preferred embodiment of the present invention regarding to a SATA data connector.

Referring to FIG. 2, a three-dimensional diagram of a preferred embodiment of the present invention regarding to a SATA data connector is showed. A SATA data connector comprises a male data connector 21 and a female data connector 22, wherein the male data connector 21 set in a computer system, a motherboard, or a circuit board 20 has a male signal interface 211 that comprises a plurality of male connection pins 212. In accordance with the male data connector 21, the female data connector 22 has a female signal interface 211 that comprises a plurality of female pins 222, and the female connection pin 222 can be electrically connected with the female connection pin 221, since the female data connector 22 connects with the male data connector 21.

In general, the SATA data connector has seven pins, as shown at 212 and 222 of the FIG. 2, wherein the first pin (2121, S1), the fourth pin (2122, S4), and seventh pin (2123, S7) are ground pins, and other pins (2142, S2, S3, S5, S6) are data pins (A+/A−/B+/B−). In the present invention, one of S1, S4, or S7 within the male connection pin 212 can be defined a power supplying pin for supplying the operating power, such as the power supplying pin 2121 (S1) is the power supplying pin in the embodiment. Besides, one of the ground pins (S1, S4, or S7) within the female connection pin 222 can be defined a power receiving pin 2221 that corresponds to the position of the power supplying pin 2121 within the male connection pin 212.

As the male signal interface 211 connects with the female signal interface 221, the power supplying pin 2121/power receiving pin 2221, ground pin 2122,2123/2222,2223, and data pin 2124/2224 can respectively connect each other. Due to the male data connector 21 is set on the circuit board 20, the power supplying pin 2121 of the male data connector 21 is electrically connected with a power line 205 of the circuit board 20. Therefore, the power line 205 of the circuit board 20, the power supplying pin 2121 and the power receiving pin 2221 can form a power supply circuit to supply the operating power to the female data connector 22. The female data connector 22 can work without the external SATA power cable, and the volume and the amount of the SATA power cable can be decreased.

The conventional female data connector (22) of SATA data connector doesn't have the power receiving pin (2221), and a ground pin is used to replace the power receiving pin (2221). Once a conventional female data connector (22) connects to the male data connector 21 with power supplying pin 2121, the SATA data connector may be damaged. Thus, a protective device 213 set on the circuit board 20 is used to connect between the power supplying pin 2121 of the male data connector 21 and the power line 205 for protecting the SATA device and the external device. In another word, as the conventional SATA female data connector (22) connects with the male data connector 21 of the invention, the protective device 213 can break the power supply circuit, such that the conventional SATA female data connector (22) can work regularly.

The protective device 213 can be an automatic resettable fuse, a diode, a switch device, such as a relay, or a circuit breaker to form a broken circuit, and the conventional SATA female data connector (22) can work regularly.

The efficacy of above mentioned broken circuit can be described as follows, for example, the power supplying pin 2121 can't supply power to the power receiving pin (2221), while the conventional SATA female data connector (22) connects to the male data connector 21 of the invention, since the protective device 213 is an automatic resettable fuse. At this time, the automatic resettable fuse 213 has to overload and trip, and the conventional SATA female data connector (22) can work normally. Once the female data connector (22) is removed from the male data connector 21, the automatic resettable fuse 213 can connect with the power supplying pin 2121 again, and the theory thereof is according to the usual fuse for protecting the extended line. Of course, the other device or circuit that can form a broken circuit can be used in the present invention.

In another embodiment of the present invention, the protective device 225 can be set within the female data connector 22 to connect with the power receiving pin 2221. As the female data connector 22 with the power receiving pin 2221 connects to the conventional male data connector (21) without the power supplying pin 2121, the operating power can't transmit to the computer system or the circuit board 20 via the power receiving pin 2221 of the female data connector 22 and the ground pin 2121 of the male data connector (21) due to the protective device 225, so the protective device 225 can protect the female data connector 22, male data connector (21), or the circuit board.

The female data connector 22 can connect with an external device 24 or an applied device 223, 2235 via a transmission line 23, wherein the applied device 223 or 2235 can be a memory, a control device, or a circuit board, and the transmission line 23 can comprise a power circuit and a data circuit. Besides, the protective device 225 can be set within the external device 24 or the applied device 223, 2235 to be another protective device 245.

Figure 3:
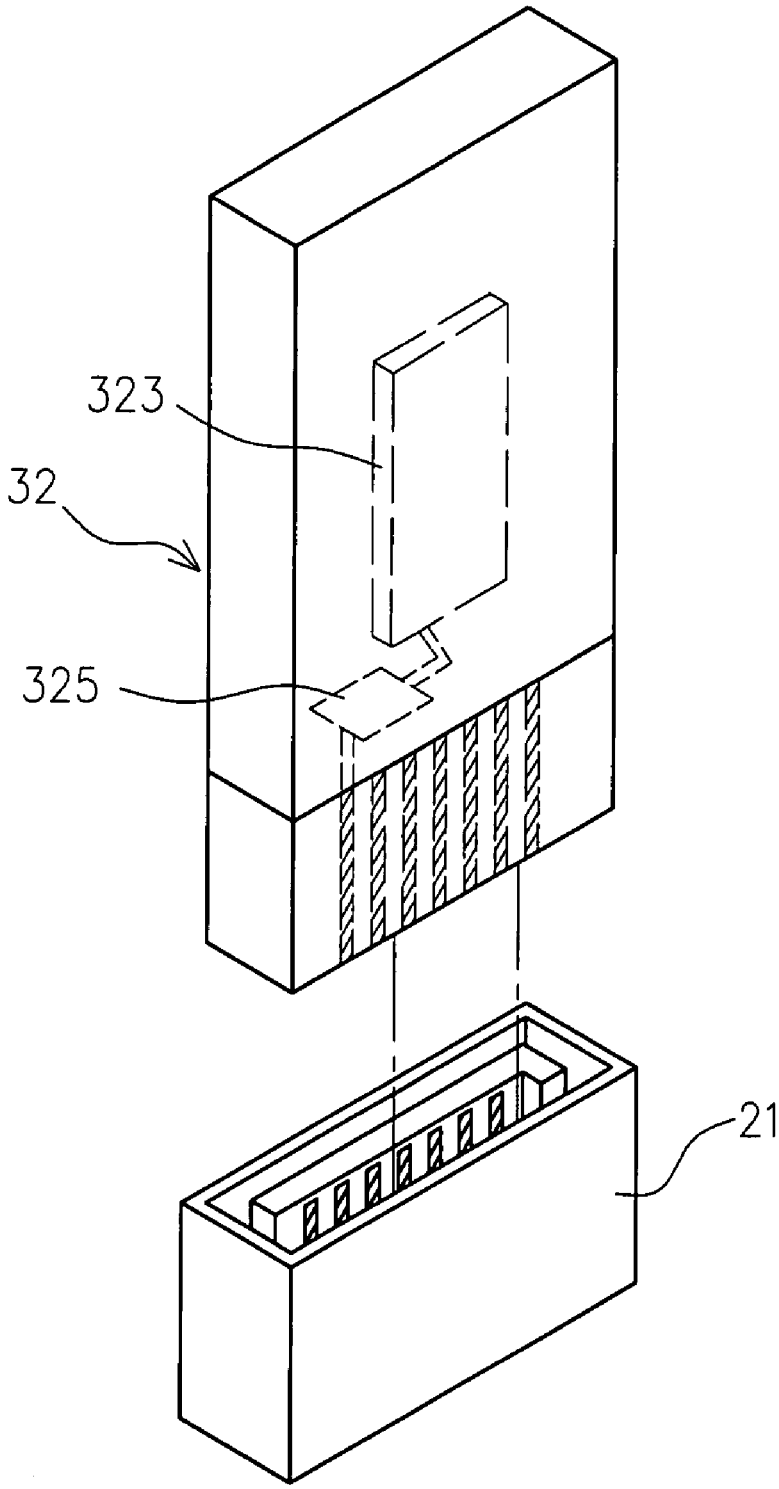
FIG. 3 is a three-dimensional diagram of another embodiment of the present invention.

Referring to FIG. 3, a three-dimensional diagram of another embodiment of the present invention is showed. Due to the volume of the applied device 323, such as circuit board, control device, or memory, is more and more small, the previous mentioned external device (24) or applied device (223) can be set within the female data connector 32 to be an applied device 323 within the female data connector 32. Therefore, the female data connector 32 can be a SATA applied device 32 that can be used to connect with the male data connector 21, such that the volume and amount of the cable can be reduced.

For example, as the applied device 323 is a memory, the SATA applied device 32 can be as a storage device that is similar to a flash disk. On the contrary, as the applied device 323 is a circuit board or a control device, the SATA applied device 32 can be a device within a personal computer, an industry computer, or a small electric device.

Figure 4:
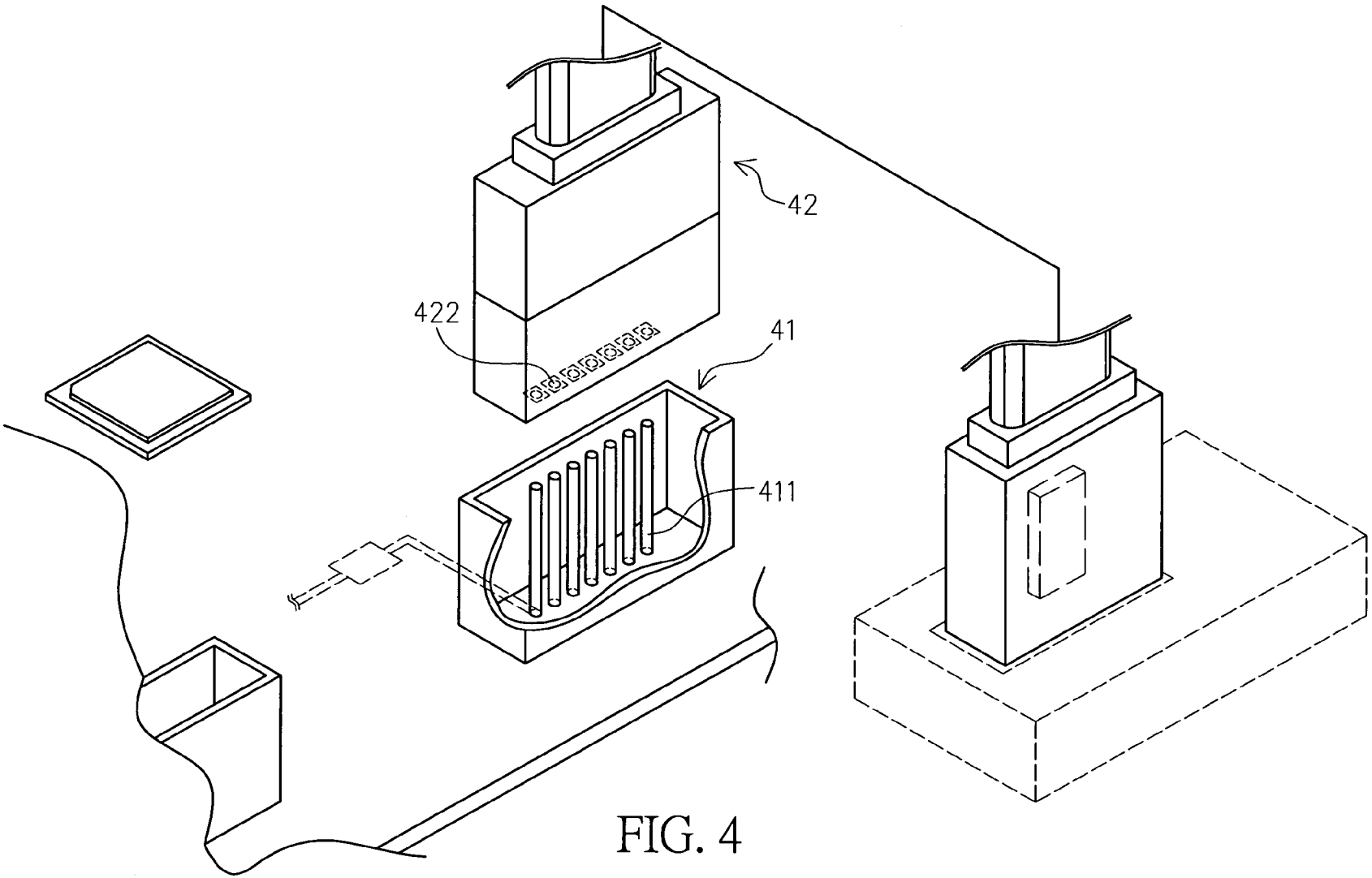
FIG. 4 is a three-dimensional diagram of another embodiment of the present invention.

Referring to FIG. 4, a three-dimensional diagram of another embodiment of the invention is showed. The male connection pin of the male data connector 41 can be a pin header 411 that is different from the foregoing gold finger (212). Besides, the female connection pin of the female data connector 42 can be a correlating female header 422 that is also different from the gold finger (222). As the male connector pin and the female connector pin are respectively the pin header 411 and the female header 422, the contact area between that can be wider than the gold finger (212) leading to the link thereof can be tight and stable. Therefore, as the male data connector 41 connects to the female data connector 42, the link of that can't be failure by an external force to ensure the stability and exactitude of the transmission data.

In above embodiment of the present invention, the SATA male data connector (21) has seven pins, and the power supplying pin 2121 can be one of the three ground pins of the prior art. As shown in the FIG. 5A, in another embodiment of the present invention, the number of the male connector pin 512 of the SATA male data connector 51 can be eight, nine, ten or more than ten, such that the SATA male data connector 51 can comprise seven pins (three ground pins and four data pins) and the other pins that can be the power supplying pins (5121 or 5122) for supplying the operating power to the female data connector 52. In accordance with the number of the male connector pin 512, the number of the female connector pin 522 can be changed, as the number of the male connector pin 512 is larger than seven.

Figure 5B:
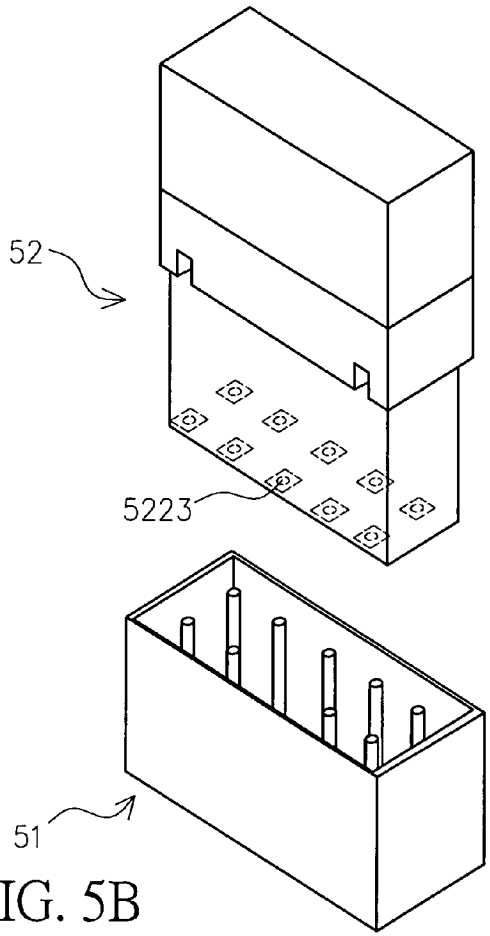
FIG. 5A to 5D are respectively the three-dimensional diagram of another embodiment of the present invention.
Figure 5A:
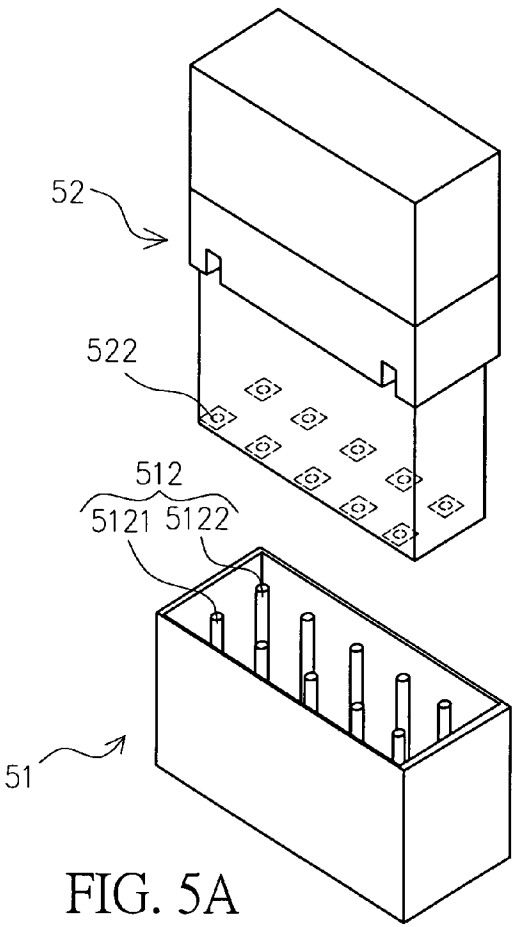

Referring to FIG. 5B, the female data connector 52 comprises a device 5223, and the position of male data connector 51 relative to the device 5223 doesn't set the male connector pin for having efficacy, as discussed earlier with reference to the "broken circuit" (note position of missing male connector pin 512 in male data connector 51).

Figure 5D:
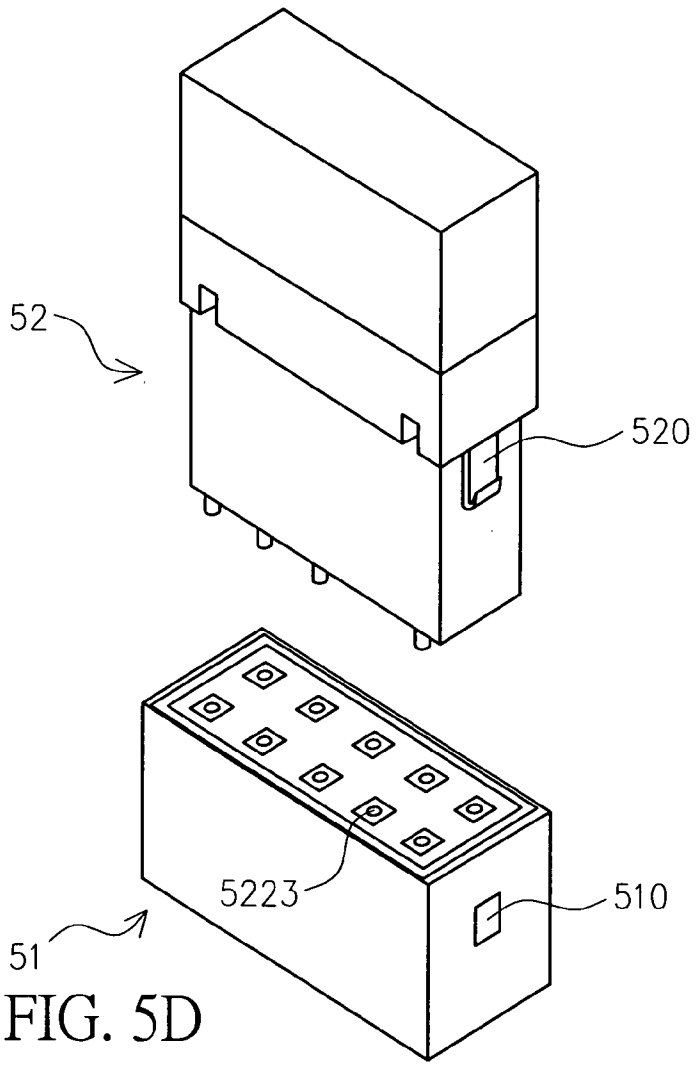
Figure 5C:
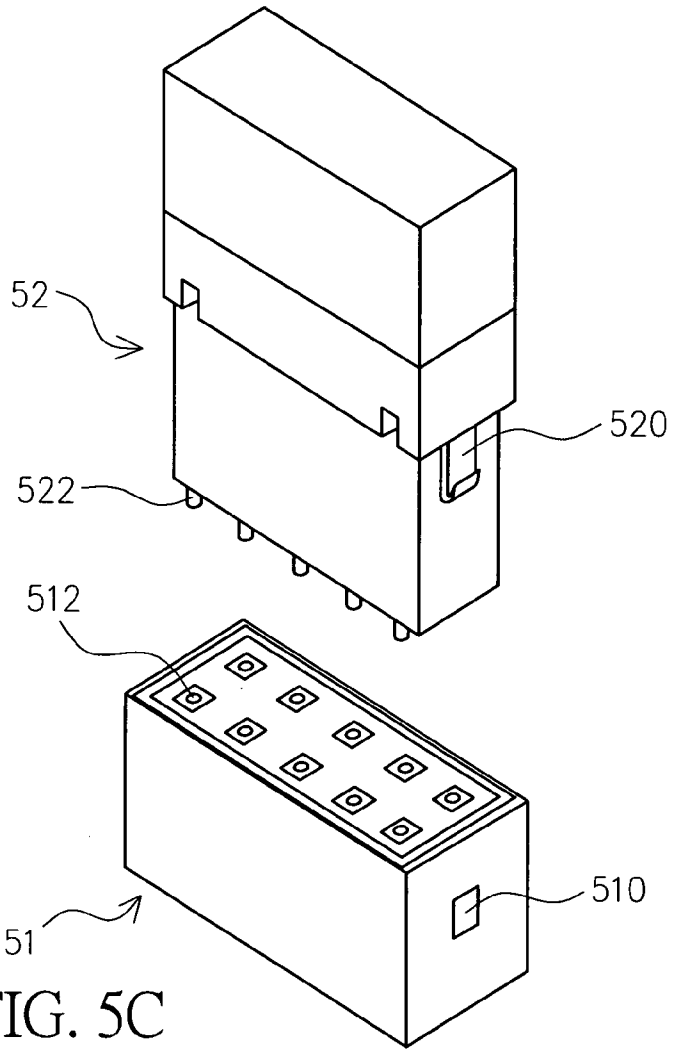

Referring to FIG. 5C and FIG. 5D, the female connector pin 522 of the female data connector 52 can be the pin header, and the male connector pin 512 of the male data connector 51 can be the female header. Of course, the male data connector 51 can comprise the foolproof device 5223.

The female data connector 52 further comprises at least one hook 520 that is set on the side of the female data connector 52, and an opening 510 that is relative to the hook 520 is set on the male data connector 51. Therefore, the hook 520 can lodge in the opening 510, and the female data connector 52 can connect with the male data connector 51 stably.

Figure 6:
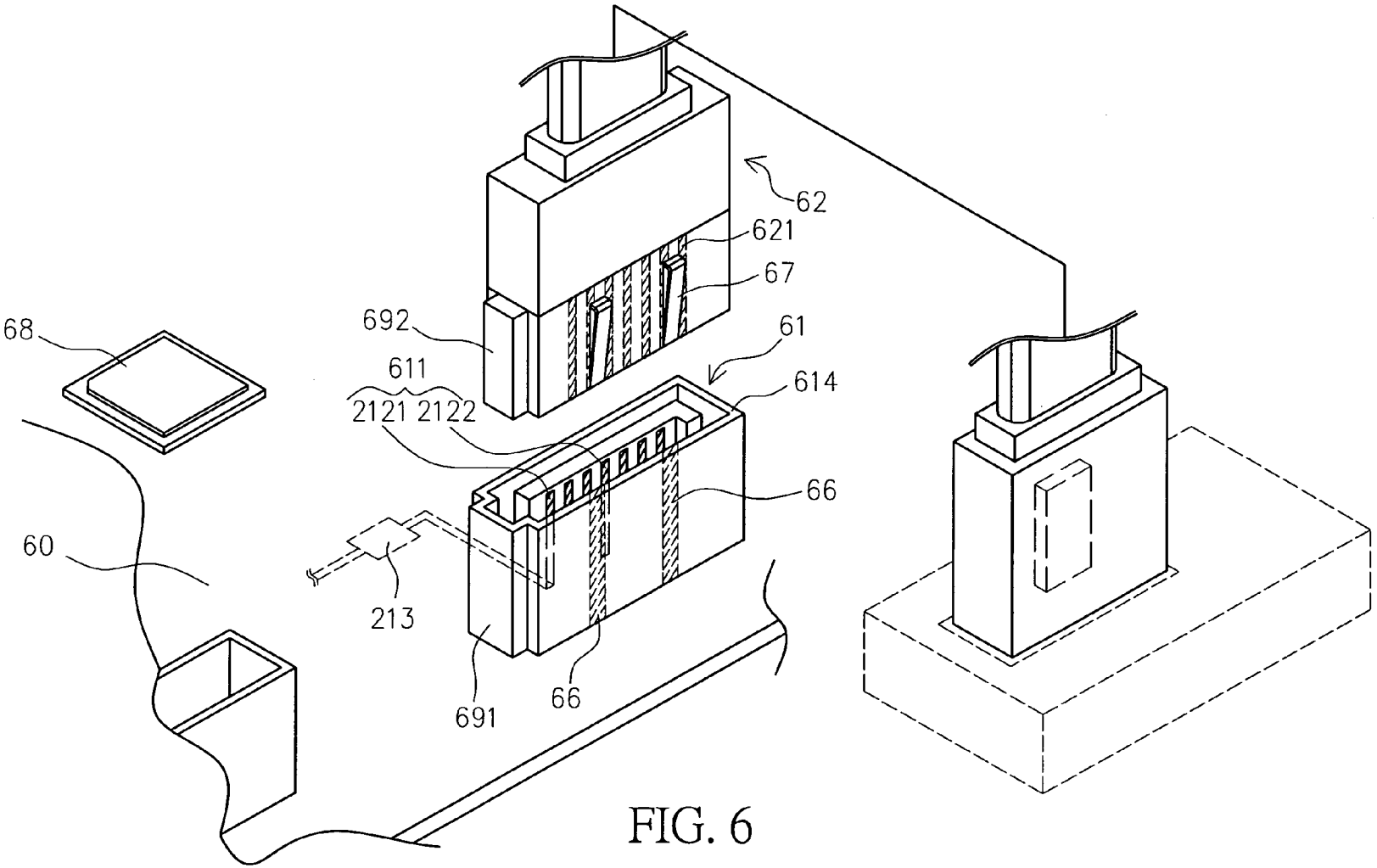
FIG. 6 is a three-dimensional diagram of another embodiment of the present invention.

Referring to FIG. 6, the male data connector 61 further comprises a power supplying line 66, and the female data connector 62 comprises a power receiving line 67 related to the power supplying line 66. Therefore, the male data connector 61 can supply the operating power to the female data connector 62 via the power supplying line 66 and power receiving line 67. Besides, the connection between the male data connector 61 and the female data connector 62 can be tighter due to the power supplying line 66 and the power receiving line 67.

The male data connector 61 can connect with device 68, such as CPU, set on the circuit board 60. A male signal interface 611 is set within the male data connector 61, and a shell 614 is set around the male data connector 61. In addition, the shell 614 can comprise the power supplying line 66 that can receive the operating power form the circuit board 60 as the device 68, and a foolproof groove 691 can be set on one side of the male data connector 61.

In accordance with the male data connector 61, the female data connector 62 comprises a female signal interface 621, a power receiving line 67, and a foolproof flange 692. In the embodiment of the present invention, the power receiving line 67 can be made of a conductive material with elasticity, such as a metal leaf spring.

The female data connector 62 can plug in the female data connector 61 safely by means of the foolproof groove 691 and the foolproof flange 692. Preferably, as the power receiving line 67 is made of the leaf spring, the power receiving line 67 of the female data connector 62 can connect with the power supplying line 66 of the shell 614 stably to form a power supply circuit for supplying power to the female data connector 62. Moreover, the connection between the female signal interface 621 of the female data connector 62 and the male signal interface 611 of the male data connector 61 will be tighter to prevent the female data connector 32 loosing.

Figure 7:
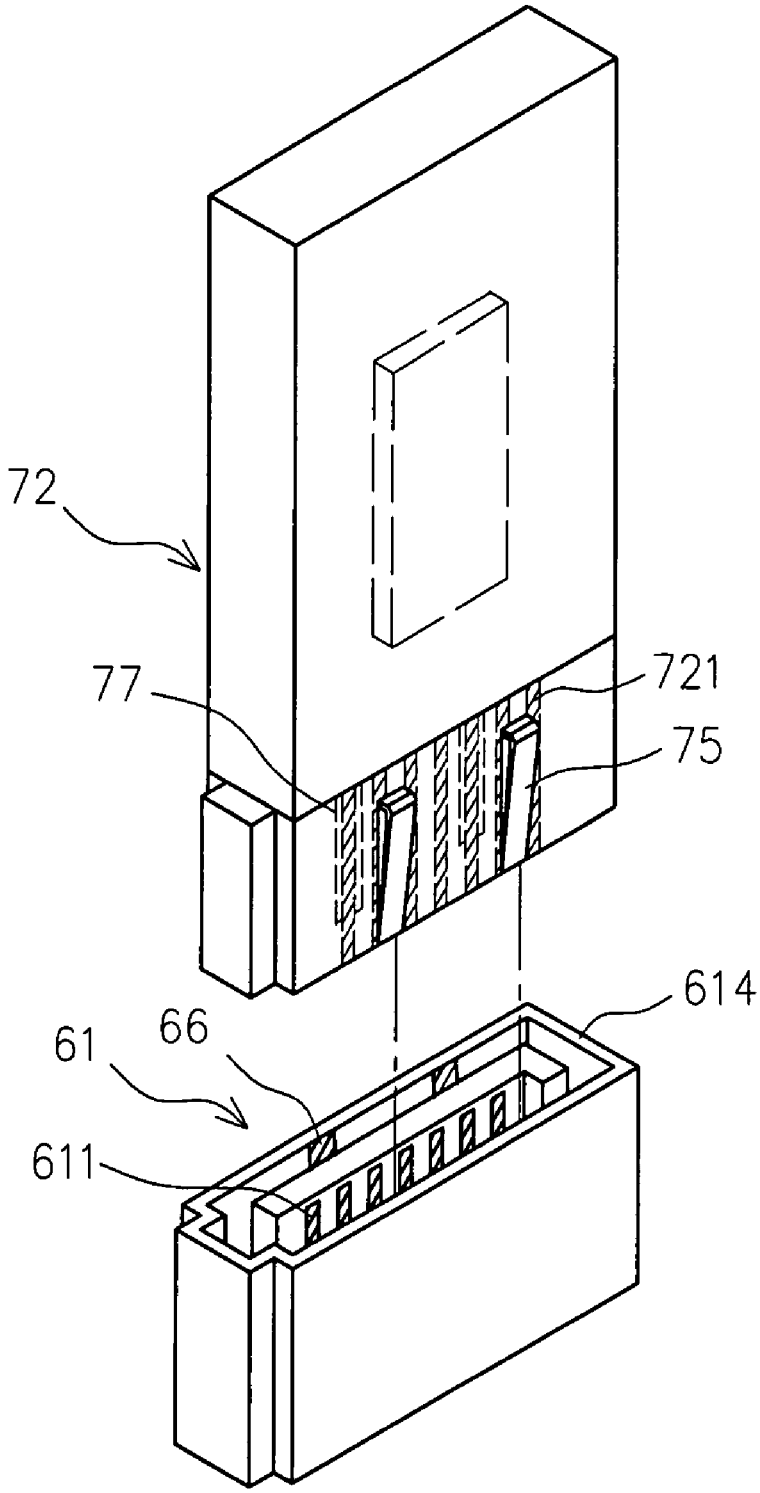
FIG. 7 is a three-dimensional diagram of another embodiment of the present invention

Referring to the FIG. 7, another embodiment of the invention is showed. The power supplying line 66 is set on one side of the SATA male data connector 61 or the shell 614, and a power receiving line 77 that is relative to the power supplying line 66 is set on the SATA female data connector 72, furthermore, a fixed leaf spring 75 is set on other side of the female data connector 72. As the female data connector 72 connects with the male data connector 61, both the female signal interface 721 and the power receiving line 77 of the female data connector 72 can respectively connect with the male signal interface 611 and the power supplying line 66 of the male data connector 61 tightly due to the fixed leaf spring 75, such that the number of the SATA power cable can be reduced.

In another embodiment of the present invention, the fixed leaf spring 75 can be set on the male data connector 61 or be omitted.

Figure 8:
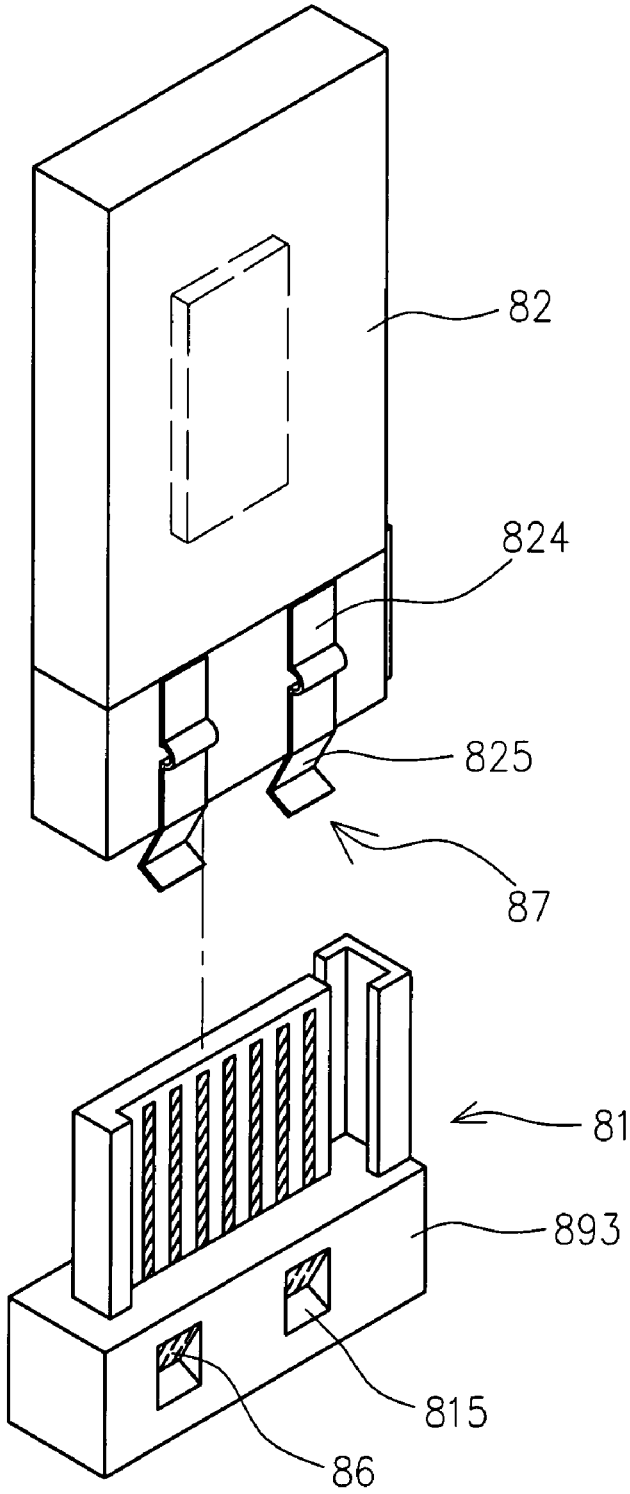
FIG. 8 is a three-dimensional diagram of another embodiment of the present invention

Referring to FIG. 8, another embodiment of the present invention is showed. A base 893 is used to replace the shell 641, and the SATA male data connector 81 can comprise the base 893. A notch 815 is set on the base 893, and a power supplying line 86 set within the notch 815 connect with the power supplying line 76 of the circuit board. Furthermore, the SATA applied device 82 has a power receiving line 87 that is formed by a leaf spring 824 with fixer 825.

Once the SATA applied device 82 connects to the male data connector 81, the fixer 825 of the SATA applied device 82 can insert to the notch 815 of the male data connector 81, after that, the SATA applied device 82 can connect with the male data connector 81 tightly. Moreover, the fixer 825 can connect with the power supplying line 86 of the male data connector 81, such that the male data connector 81 can supply the operating power to the SATA applied device 82 via the power supplying line 86 and the power receiving line 87.

Figure 9:
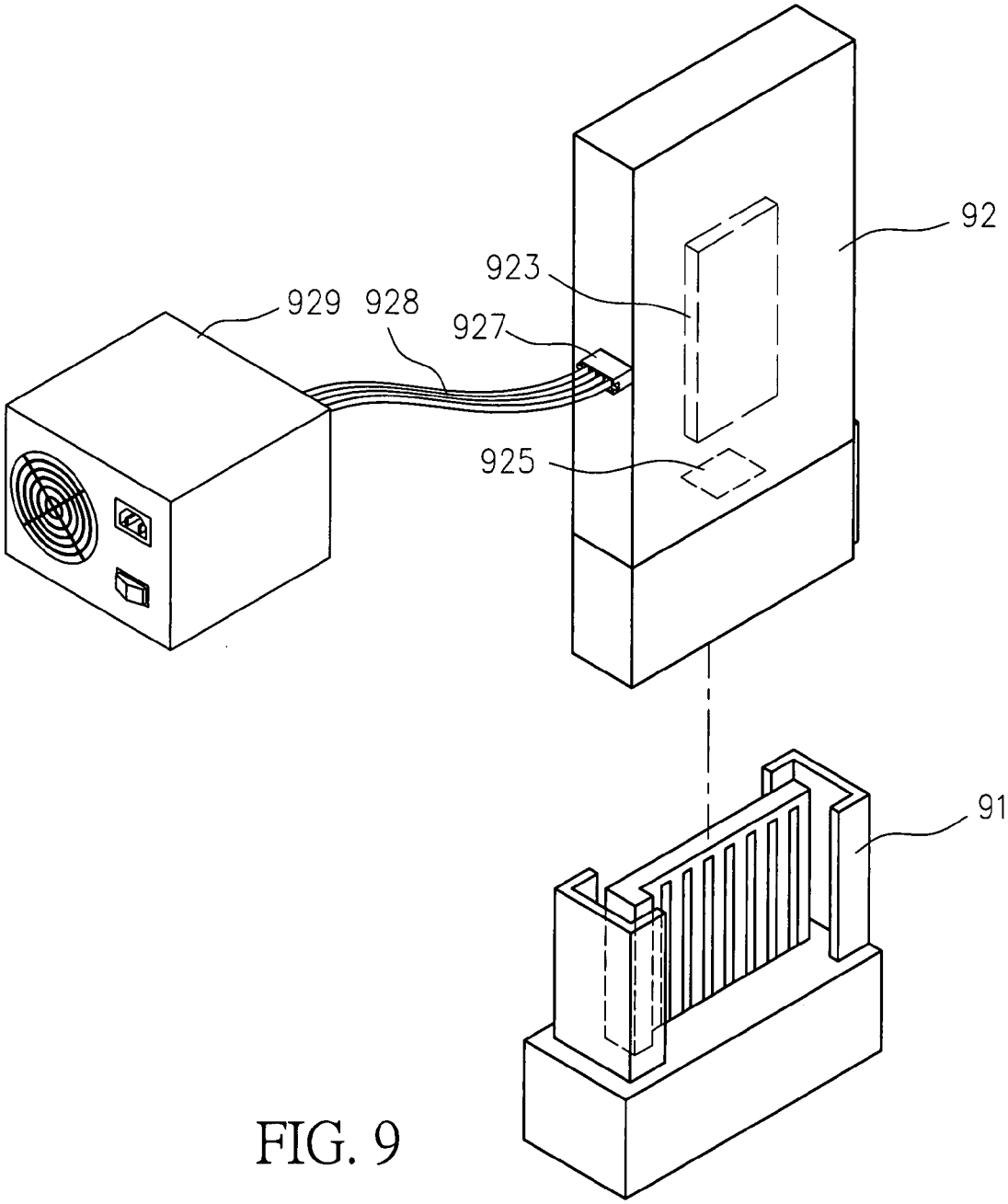
FIG. 9 is a three-dimensional diagram of another embodiment of the present invention

Referring to FIG. 9, a three-dimensional diagram of another embodiment of the present invention is showed. The SATA male data connector 91 has nothing relative to the power supplying line (66), such that the SATA male data connector 91 can be suitable for the conventional circuit board or computer system. The SATA applied device 92 comprises a power connection hole 927 that can be used to connect with a SATA power cable 928, thus, a power supply 929 can connect with the power connection hole 927 of the SATA applied device 92 via a SATA power cable 928 for supplying the operating power to the applied device 923 within the SATA applied device 92.

On another hand, once the SATA applied device 92 comprises a power receiving line or a power receiving pin for being used to connect with the power connection hole 927/SATA power cable 928 and the applied device 923. In another word, the power receiving line or the power receiving pin of the female data connector 92 can be as a connection line set between the power connection hole 927 and the applied device 923.

In another embodiment of the present invention, as the SATA applied device 92 comprises a power receiving pin 2221, a protective device 925 can be used to connect with the power receiving pin 2221 within the SATA applied device 92 to prevent the operating power from the power supply 929 damaging the computer system or the circuit board.

Although the SATA data connector is used to describe the structure of the invention in the previous mentioned embodiment, the feature and technique of the invention can be used in other type SATA data connector, such as the e-SATA data connector.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention.

The invention claimed is:

1. A SATA data connector, comprising:

a male data connector consisting of one power supplying pin, two ground pins, and four data pins, said power supplying pin being electrically connected directly with a power line of a circuit board; wherein the power supplying pin replaces one of three ground pins initially disposed within the male data connector of the standard SATA data connector; and a female data connector consisting of one power receiving pin, two ground pins, and four data pins, wherein said female data connector connects with said male data connector, and said power receiving pin of said female data connector contacts said power supplying pin of said male data connector, such that said power line of said circuit board, said power supplying pin of said male data connector, and said power receiving pin of said female data connector forms an uninterrupted integral power supply circuit; wherein the power receiving pin replaces one of three ground pins initially disposed within the female data connector of a standard SATA connector.

2. The SATA data connector of claim 1, wherein said power receiving pin connects with a protective device, and said protective device can be one of an automatic resettable fuse, a diode, a switch device, or a circuit breaker.

3. The SATA data connector of claim 1, further comprising a protective device being set between said power supplying pin and said power line of said circuit board, wherein said protective device can be one of an automatic resettable fuse, a diode, a switch device, or a circuit breaker.

4. The SATA data connector of claim 1, wherein said male connector pin can be one of a gold finger, a pin header, or a female header, and said female connector pin can be one of a gold finger, a female header, or a pin header.

5. The SATA data connector of claim 1, wherein said female data connector comprises an applied device, such that said female data connector can be as a SATA applied device, and said applied device can be one of a memory, a control device, a circuit board, or a combination thereof.

6. The SATA data connector of claim 1, wherein said female data connector comprises a power connection hole that connects with said power receiving pin, and said power connection hole connects with a power supply via a SATA power cable.

* * * * *